US008690430B2

(12) United States Patent
Burggren

(10) Patent No.: US 8,690,430 B2
(45) Date of Patent: Apr. 8, 2014

(54) STORAGE BAG HAVING A SLIDER WITH RIDGES THAT PRESSES TOGETHER AND SEPARATES INTERLOCKING PROFILES OF FASTENER STRIPS

(75) Inventor: Keegan E. Burggren, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 13/528,264

(22) Filed: Jun. 20, 2012

(65) Prior Publication Data

US 2013/0343678 A1 Dec. 26, 2013

(51) Int. Cl.

| | |
|---|---|
| ***B65D 33/16*** | (2006.01) |
| ***B65D 30/16*** | (2006.01) |
| ***B65D 30/08*** | (2006.01) |
| ***B65D 30/20*** | (2006.01) |
| ***A44B 1/04*** | (2006.01) |

(52) U.S. Cl.
USPC ..... 383/64; 383/104; 383/116; 383/120; 24/399; 24/400

(58) Field of Classification Search
USPC ..... 383/64, 104, 120, 116; 24/399, 400; D11/221
See application file for complete search history.

(56) References Cited

U.S. PATENT DOCUMENTS

| | | | | |
|---|---|---|---|---|
| 5,067,208 | A | 11/1991 | Herrington, Jr. et al. | |
| 5,088,971 | A | 2/1992 | Herrington | |
| 5,131,121 | A | 7/1992 | Herrington, Jr. et al. | |
| 5,161,286 | A | 11/1992 | Herrington, Jr. et al. | |
| 5,405,478 | A | 4/1995 | Richardson et al. | |
| 5,442,837 | A | 8/1995 | Morgan | |
| 5,448,807 | A | 9/1995 | Herrington, Jr. | |
| 5,664,299 | A | 9/1997 | Porchia et al. | |
| 5,722,128 | A * | 3/1998 | Toney et al. | 24/400 |
| 5,836,056 | A * | 11/1998 | Porchia et al. | 24/400 |
| 5,950,285 | A | 9/1999 | Porchia et al. | |
| 6,928,702 | B1 * | 8/2005 | Savicki et al. | 24/30.5 R |
| D517,948 | S * | 3/2006 | Schreiter | D11/221 |
| 7,188,394 | B2 * | 3/2007 | Turvey et al. | 24/415 |
| 7,553,082 | B2 * | 6/2009 | Yoder | 383/64 |

(Continued)

FOREIGN PATENT DOCUMENTS

| | | | |
|---|---|---|---|
| EP | 1369352 | A2 | 12/2003 |
| WO | WO00/76342 | A1 | 12/2000 |
| WO | WO01/95756 | A1 | 12/2001 |
| WO | WO2009/132199 | A1 | 10/2009 |

OTHER PUBLICATIONS

PCT/US2013/046515 International Search Report and Written Opinion dated Dec. 3, 2013.

*Primary Examiner* — Jes F Pascua

(57) ABSTRACT

A storage bag has a first fastener strip positioned adjacent to an opening of the bag that includes at least one interlocking profile. A second fastener strip positioned adjacent to the opening of the bag also includes at least one interlocking profile. A slider includes a first sidewall, a second sidewall, and a top wall connecting the first sidewall and the second sidewall. The slider includes (a) a plurality of ridges extending from a first sidewall, the plurality of ridges extending farther from the first sidewall at the ends of the slider than at a position at the center of the length of the slider, and (b) a plurality of ridges extending from a second sidewall, the plurality of ridges extending further from the second sidewall at the ends of the slider than at a position at the center of the length of the slider.

7 Claims, 8 Drawing Sheets

(56) References Cited

U.S. PATENT DOCUMENTS

| | | | | |
|---|---|---|---|---|
| 7,670,051 | B2 * | 3/2010 | Chaturvedi | 383/64 |
| 2004/0252917 | A1 | 12/2004 | Chang | |
| 2005/0281492 | A1 | 12/2005 | Turvey et al. | |
| 2006/0269170 | A1 * | 11/2006 | Chaturvedi | 383/64 |
| 2008/0089618 | A1 * | 4/2008 | Blythe | 383/25 |
| 2012/0027322 | A1 | 2/2012 | Ackerman | |

* cited by examiner

STORAGE BAG HAVING A SLIDER WITH RIDGES THAT PRESSES TOGETHER AND SEPARATES INTERLOCKING PROFILES OF FASTENER STRIPS

BACKGROUND

1. Field of the Invention

Our invention relates to a closure mechanism for a storage bag. More specifically, our invention relates to a slider for a fastener assembly that seals and unseals a plastic storage bag.

2. Related Art

Storage bags or pouches made from flexible plastic materials are well known. Such bags can be used to store a variety of items, with one of the most common uses being the storage of perishable food. In order to effectively preserve food, and in order to prevent food or other items from leaking out of a storage bag, the storage bag often includes a sealing mechanism for closing the opening of the bag. One common type of sealing mechanism, which is often referred to as a fastener assembly or a zipper, includes interlocking closure profiles at a top end of a bag, with the interlocking closure profiles being pressed and pulled apart by a slider that is movable across the top end of the bag. Examples of storage bags that include such a sealing mechanism are sold by the assignee of this application under the ZIPLOC® trademark.

The slider of a fastener assembly must be gripped and moved by a user to seal and to unseal a storage bag. As such, it is advantageous for the slider to be easily grippable by the user, which could lead to the idea of making the slider as large as possible. Because a slider extends along the opening of the bag, however, there may be problems with increasing the size of a slider on a given bag. In particular, a larger slider may block more of the opening of the bag than would a smaller slider.

SUMMARY OF THE INVENTION

According to one aspect of the invention, a slider is provided for use with a closure mechanism of a resealable bag. The slider includes a first sidewall extending along a length of the slider, a second sidewall extending along the length of the slider, and a top wall connecting the first and second sidewalls. The top wall is positioned on only one side of a center of the length of the slider. A first pressing leg is positioned adjacent to one end of the top wall, and a second pressing leg is positioned adjacent to the one end of the top wall and adjacent to the first pressing leg. A separating leg extends adjacent to the second end of the top wall.

According to another aspect of the invention, a slider is provided for use with a closure mechanism of a bag. The slider includes a first sidewall extending along a length of the slider, a second sidewall extending along the length of the slider, and a top wall connecting the first and second sidewalls. A first guide leg extends from the first sidewall at a position adjacent to a first end of the slider, and a second guide leg extends from the first sidewall at a position spaced from the first end. A first guide leg is provided extending from the second sidewall at a position adjacent to the first end of the slider and adjacent to the first guide leg extending from the first sidewall, and a second guide leg extends from the second sidewall at a position spaced from the first end of the slider and adjacent to the second guide leg extending from the second sidewall. The slider is configured such that the first guide leg of the first sidewall and the first guide leg of the second sidewall are positioned closer to a center of the length of the slider than the second end of the slider.

Yet another aspect of the invention is a storage bag. The storage bag includes a first side surface, and a second side surface connected to the first side surface so as to define an interior of the bag with an opening thereto. A first fastener strip is positioned adjacent to the opening of the bag, with the first fastener strip including at least one interlocking profile. A second fastener strip is positioned adjacent to the opening of the bag, with the second fastener strip including at least one interlocking profile configured to interlock with the first interlocking profile of the first fastener strip. A slider is provided that includes a first sidewall, a second sidewall, and a top wall connecting the first sidewall and the second sidewall. The slider is configured to press together the interlocking profiles of the first and second fastener strips as the slider moves from the first end to the second end of the bag, and to separate the interlocking profiles of the first and second fastener strips as the slider moves from the second end to the first end of the bag. A first end-stop is formed by the first and second fastener strips adjacent to the first end of the bag, and a second end-stop is formed by the first and second fastener strips adjacent to the second end of the bag. The first end-stop can be received between the first and second sidewalls of the slider to a point that is substantially at a center of the length of the slider.

DETAILED DESCRIPTION OF THE INVENTION

Our invention is directed to a closure mechanism for a storage bag, and a corresponding storage bag that includes such a slider. The slider is configured to be larger than other sliders provided for similarly-sized bags. The larger slider, however, does not reduce the size of the opening of the bag as compared to smaller sliders. In embodiments of the invention, the larger size of the slider, as well as other features, make the slider easier to grip.

As will be apparent from the description herein, the term "bag" encompasses a broad range of structures designed to contain items, such as pouches, envelopes, packets, and the like. In general, the term bag as used herein simply means a somewhat flexible container with an opening, with the bag being useable to carry any number of items.

Figure 1:
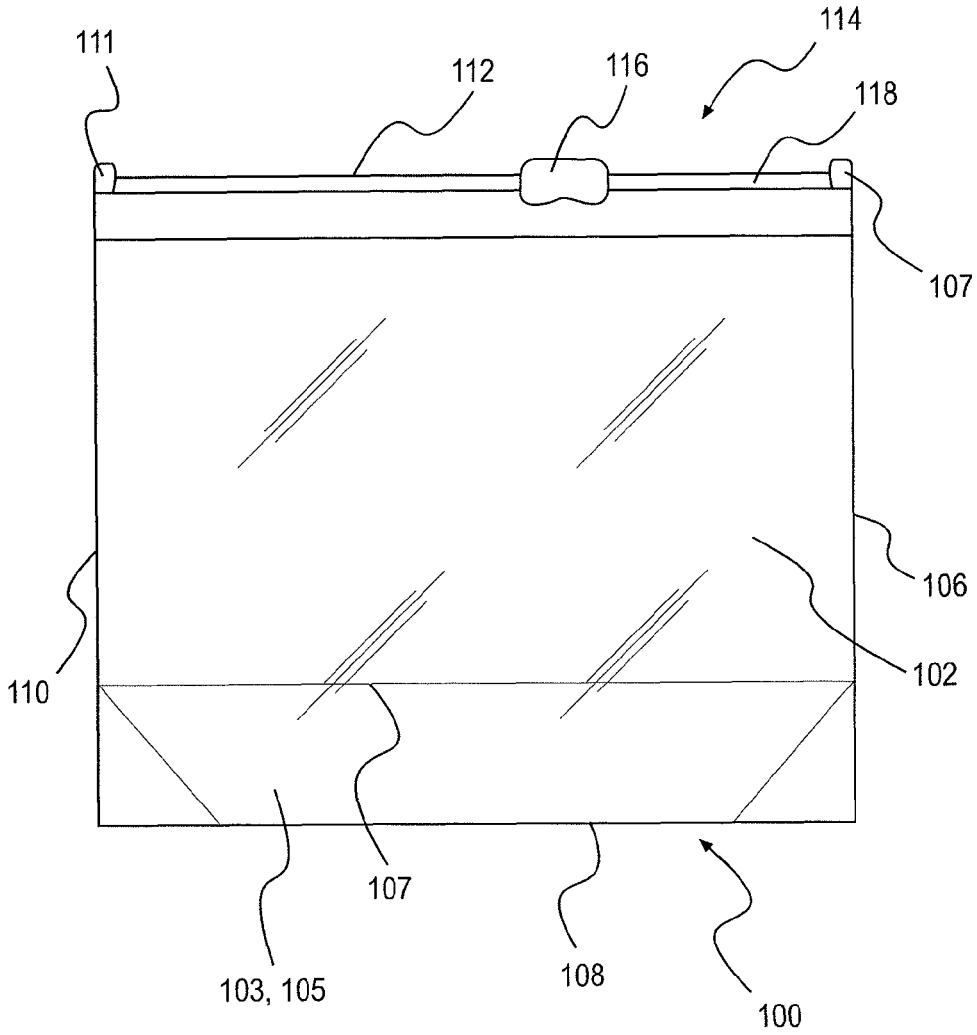
FIG. 1 is a side view of a bag according to an embodiment invention.
Figure 2:
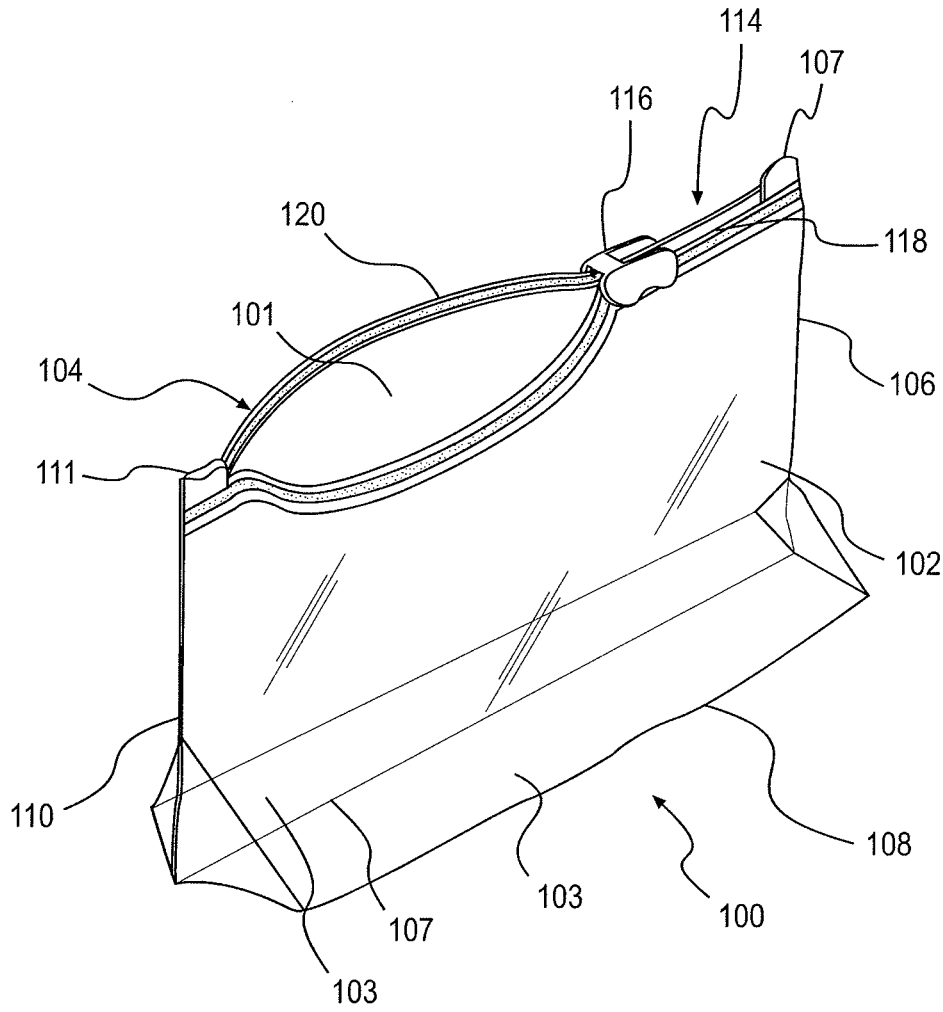
FIG. 2 is an elevation view of the bag shown in FIG. 1.

FIGS. 1 and 2 depict a bag 100 according to an embodiment of the invention. The bag 100 includes a first side surface 102 and a second side surface 104. The first and second side surfaces 102 and 104 are connected along first and second ends 106 and 110, and along a bottom end 108 of the bag 100. An opening 101 that is sealable with a fastener assembly 114 and slider 116 is formed at the top end 112 of the bag 100. The fastener assembly 114 and slider 116 will be described below. The ends of the fastener assembly 114 are formed as end-stops 107 and 111, which will also be described below.

The bottom end 108 of the bag 100 is formed by gusset surfaces 103 and 105 that are connected to the first and second side surfaces 102 and 104. The gusset surfaces 103 and 105 fold about a fold line 107 such that the bottom end 108 of the bag 100 has an expanded configuration with the first and second surface 102 and 104 separated from each other, and a flat configuration wherein the gusset surfaces 103 and 105 are folded about line 107 to position the first and second surfaces 102 and 104 adjacent to each other. This configuration is often referred to as a "k-seal." In alternative embodiments, however, the bag 100 is formed without the k-seal type bottom, such as by directly connecting the first side surface 102 to the second side surface 104 at the bottom end 108.

As will be described below, the side surfaces 102 and 104 of the bag 100 may be formed from a variety of plastic materials. As such, the side surfaces 102 and 104 may be directly laminated together at ends 106 and 110 of the bag 100. In other embodiments, however, additional surfaces may be provided to connect the first and second side surfaces 102 and 104 at ends 106 and 110 of the bag 100. For example, a gusset type connection may be formed at the ends 106 and 110 between the first and second sides 102 and 104, thereby allowing the side surfaces 102 and 104 to expand at ends 106 and 110 in the same manner as the bottom end 108 described above. Those skilled in the art will recognize the many configurations to form a resealable bag that includes a fastener assembly as described herein.

The bag 100 may be formed from a variety of materials. In the embodiments discussed herein, the bag 100 is formed from thermoplastics, such as, high density polyethylene (HDPE), low density polyethylene (LDPE), linear low density polyethylene (LLDPE), and polypropylene (PP). Other materials that may be used to form a bag according to the invention include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. In a specific embodiment of the invention, the side surfaces 102 and 104 of the bag 100 are formed as a multilayer laminate structure including a sixty gauge nylon layer laminated to a 5.5 mil LDPE/LLDPE sealant layer. Other embodiments with a laminate structure include a PET layer laminated to an LDPE/LLDPE sealant layer. Still other embodiments include an LDPE/LLDPE blend.

The fastener assembly 114 can also be manufactured from a variety of materials such as those described above as being capable of forming the sides 102 and 104 of the bag 100. Further, the slider 116 of the fastener assembly, which will be more fully described below, can be formed of any suitable material, such as, for example, polybutylene terephthalate, polypropylene, nylon, polystyrene, acetal, polyketone, high density polyethylene, polycarbonate, acrylonitrile butadiene styrene, or the like. Those skilled in the art will recognize numerous other possible materials that could be used to construct elements of the bag.

The bag 100 may be constructed using a variety of processes and techniques. In some embodiments, the first and second side surfaces 102 and 104 are formed from a single sheet of plastic material that is folded in a manner to create the gusset surfaces 103 and 105 at the bottom end 108. In this embodiment, the first and second side surfaces 102 and 104 are sealed along ends 106 and 110, as described above. In other embodiments, each of the side surfaces 102 and 104, as well as the gusset surfaces 103 and 105, are formed as separate pieces, which are attached to create the final bag structure. Those skilled in the art will recognize numerous other methods for attaching separate pieces together to form the bag 100, such as adhesion, heat sealing, ultrasonic welding, lamination, and the like.

Figure 3:
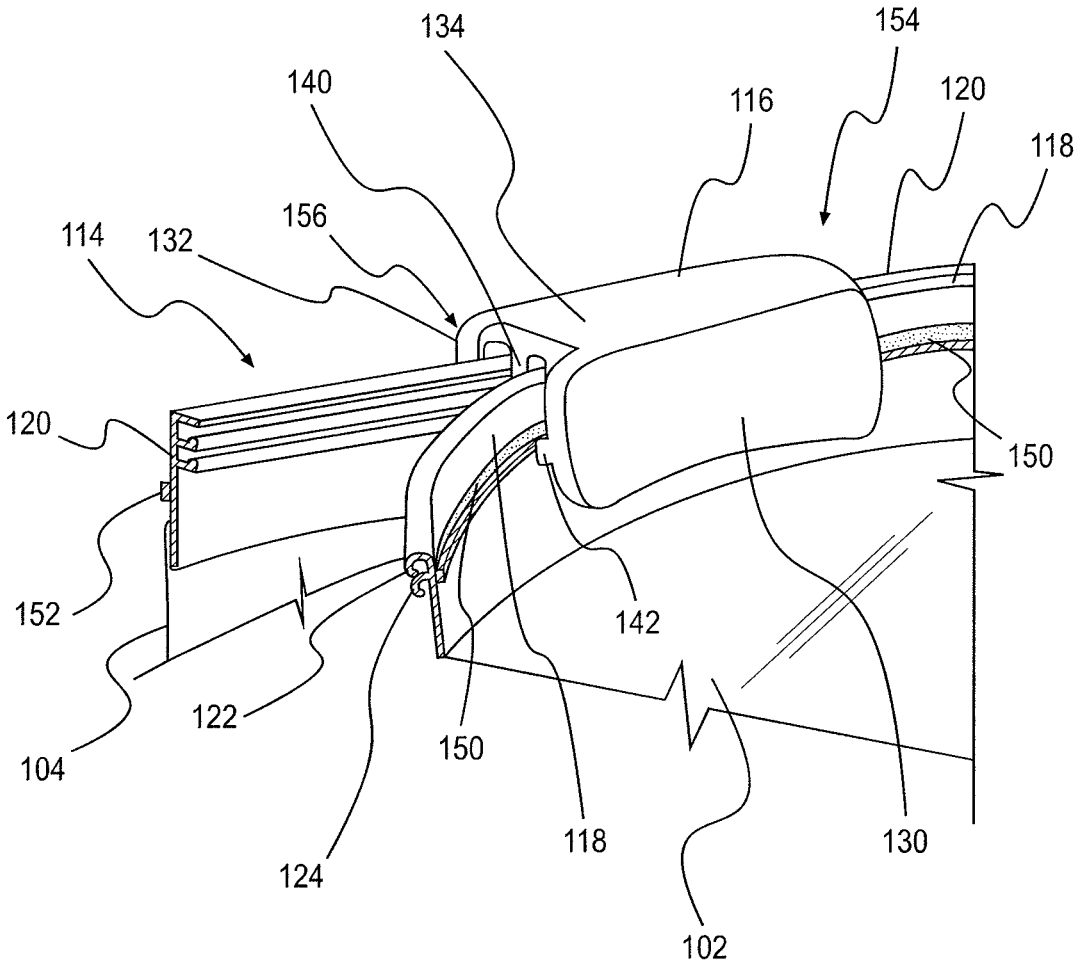
FIG. 3 is an elevation view of the fastener assembly of a bag according to the invention.
Figure 4:
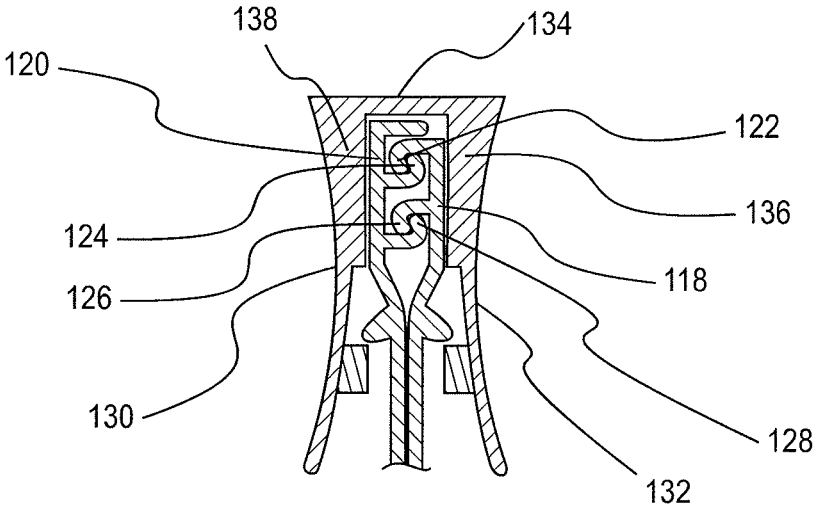
FIG. 4 is a cross-sectional view of the fastener assembly shown in FIG. 3 being closed by a slider.
Figure 5:
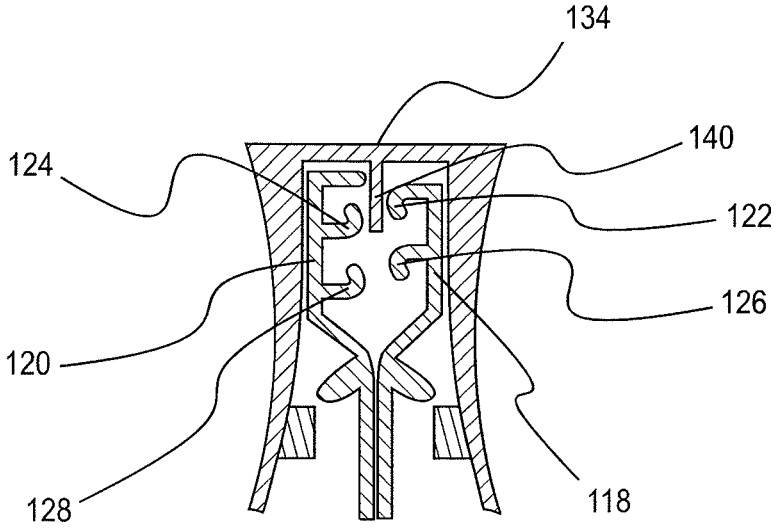
FIG. 5 is a cross-sectional view of the fastener assembly shown in FIG. 3 being opened by a slider.

The fastener assembly 114 with slider 116 is provided along the top end 112 adjacent to the opening 101 of the bag 100. Details of the fastener assembly 114 are shown in FIGS. 3-5. The slider 116 functions to seal and to unseal the opening 101 by interlocking profiles 122, 124, 126, and 128 formed on the fastener strips 118 and 120, as will be described below. It should be noted that while the depicted embodiment includes two interlocking profiles 122 and 124 on the first fastener strip 118 and two interlocking profiles 126 and 128 on the second fastener strip 120, in other embodiments, only one interlocking profile may be provided on the first and second fastener strips 118 and 120. In still other embodiments, more than two interlocking profiles are provided on the first and second fastener strips 118 and 120.

In embodiments of the invention, the fastener strips 118 and 120 are initially formed separately from the other parts of the bag 100. The fastener strips 118 and 120 are then connected to the side surfaces 102 and 104. As discussed above, the elements of bag 100 including the side surfaces 102 and 104 and the fastener strips 118 and 120 can be formed from plastic materials. Thus, the separately formed fastener strips 118 and 120 may be connected to the side surfaces 102 and 104 of the bag, for example, by a lamination process wherein the fastener strips 118 and 120 are bonded to the side surfaces 102 and 104. Of course, those skilled in the art will recognize that there are many other techniques for forming and connecting the fastener strips 118 and 120, and will also recognize that the fastener strips 118 and 120 could be integrally formed with the rest of bag 100.

Figure 8:
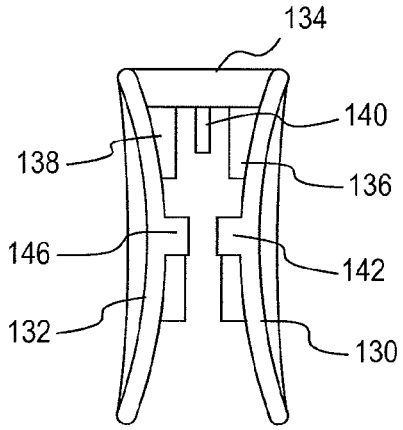
FIG. 8 is a view of one end of a slider according to the invention.
Figure 7:
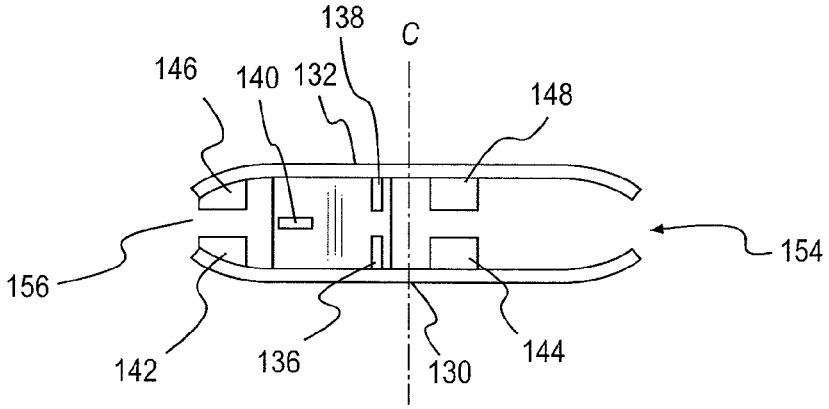
FIG. 7 is a bottom view of a slider according to the invention.
Figure 9:
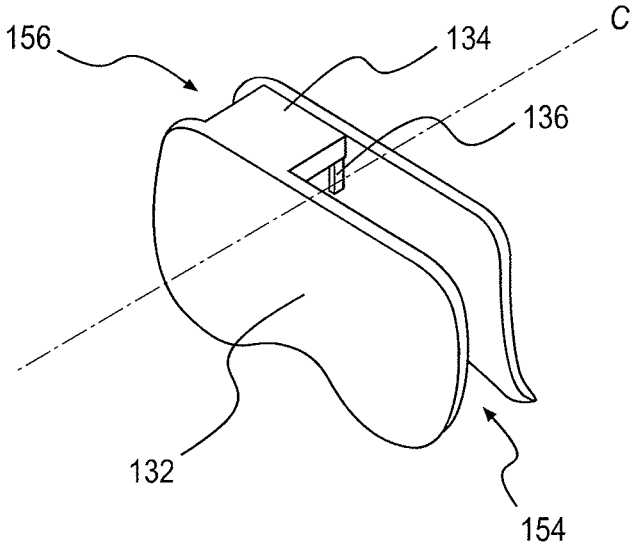
FIG. 9 is an elevation view of a slider according to an embodiment of the invention.

The closure profiles 122, 124, 126, and 128 are pressed together and separated by the slider 116 moving along the top end 112 of the bag 100. The slider 116 includes a first sidewall 130 and a second sidewall 132, with the first and second sidewalls 130 and 132 extending the length of the slider 116. A top wall 134 connects the first and second sidewalls 130 and 132. As shown in FIGS. 4, 7, and 8, a first pressing leg 136 extends from inner surfaces of the first sidewall 130 and the top wall 134, and a second pressing leg 138 extends from inner surfaces of the second sidewall 132 and the top wall 134. The adjacently-positioned first and second pressing legs 136 and 138 are configured to press together the first and second fastener strips 118 and 120 as the slider 116 moves along the fastener strips 116 and 120 in a direction from the end 110 to the other end 106 of the bag 100. As such, the interlocking profile 122 interlocks with the interlocking profile 124. Additionally, with the interlocking profile 122 pressed together with the interlocking profile 124, the interlocking profiles 126 and 128 are also pressed into an interlocking position.

It should be noted that the closure profiles 122, 124, 126, and 128 are not limited to the shape and configuration shown in the figures. Indeed, those skilled in the art will recognize the wide variety of different shaped and configured profiles that could be formed with the fastener strips 118 and 120. Moreover, there is no limit on the number of profiles that are formed with the fastener strips 118 and 120. For example, in some embodiments, only one pair of closure profiles are provided, whereas other embodiments include more than two pairs of closure profiles.

It should be noted that although the first and second pressing legs 136 and 138 are shown in the depicted embodiment as extending from the top wall 134 and sidewalls 130 and 132, in other embodiments, the first and second pressing legs 136 and 138 may extend from the top wall 134 and not the sidewalls 130 and 132, or the pressing legs 136 and 138 may extend from the sidewalls 130 and 132 and not the top wall 134. That is, it is not necessary for the first and second pressing legs 136 and 138 to be connected to both the top wall 134 and sidewalls 130 and 132. Rather, the only requirement is that that the pressing legs 136 and 138 be positioned to press together the interlocking profiles 122 and 124, as described above. Additionally, in the depicted embodiment, the first and second pressing legs 136 and 138 only extend to a position adjacent to the interlocking profiles 122 and 124, and not to a position adjacent to the interlocking profiles 126 and 128. In other embodiments, the first and second pressing legs 136 and 138 may be further extended so as also to be positioned adjacent to the interlocking profiles 126 and 128.

As shown in FIGS. 3, 5, and 8, a separating leg 140 extends from the end of the top wall 132 that is opposite to the end of the top wall 132 having the first and second pressing legs 136 and 138. The separating leg 140 is positioned on the slider 116 so as to extend between the closure profiles 122 and 124 such that the separating leg 140 separates the closure profiles 122 and 124 as the slider 116 is moved along the fastener strips 118 and 120 in a direction from the end 106 to end 110 of the bag 100.

Figure 6:
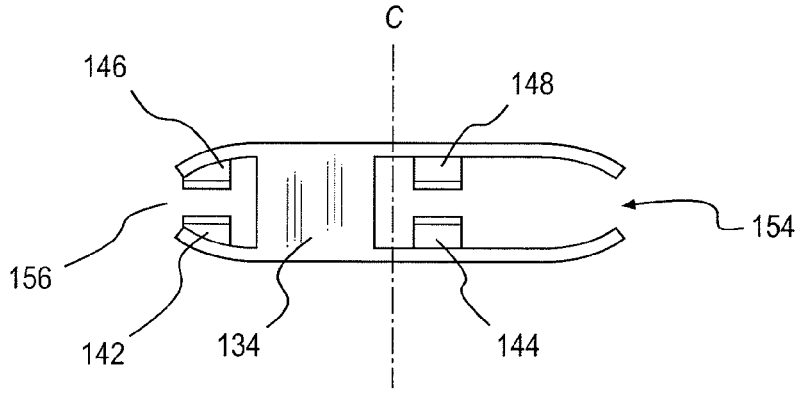
FIG. 6 is a top view of a slider according to the invention.

The shape and configuration of the slider 116 can be seen in FIGS. 6-8. The slider 116 includes first and second guide legs 142 and 144 extending from the first sidewall 130. Similarly, the slider 116 includes first and second guide legs 146 and 148 extending from the second sidewall 132. The first guide leg 142 of the first sidewall 130 is positioned adjacent to first guide leg 146 of the second sidewall 132, and the second guide leg 144 of the first sidewall 130 is positioned adjacent to the second guide leg 140 of the second sidewall 132. The guide legs 142 and 144 are configured and positioned to slide against a corresponding guide profile 150 on the first fastener strip 118, while the guide legs 146 and 148 are configured to and positioned to slide against a corresponding guide profile 152 on the second fastener strip 120. The guide legs 142 and 144 and corresponding guide profiles 150 and 152 thereby act to direct the slider 116 as it moves between ends 106 and 110 of the bag 100. Additionally, as the guide legs 142 and 144 are formed beneath the guide profiles 150 and 152, the guide profiles 150 and 152 contact the guide legs 142 and 144 if the slider 116 is pulled upward, thereby preventing the slider 116 from becoming detached from the fastener strips 118 and 120.

As can also be seen from FIGS. 6-8, the slider 116 has an asymmetric configuration. In particular, the top wall 134 of the slider 116 is positioned adjacent to a center C of the length of the slider 116, but, as shown in FIG. 6, the top wall 134 extends on only one side of a center C of the length of the slider 116. Moreover, there is no other structure between the sidewalls 130 and 132 of the slider 116 at the center C of the length of the slider 116. As will be discussed below, this offset of the top wall 134 towards the second side 156 of the slider 116 allows the slider 116 to be moved further towards the end 106 of the bag 100. It should be noted that in some embodiments, the top wall 134 may extend from a position at the center C of the length of the slider 116, whereas in other embodiments, the top wall 134 may extend from a position offset from the center C towards the end 156 of the slider 116.

The slider is also asymmetric with respect to the positioning of the guide legs 142, 144, 146, and 148. Specifically, the guide legs 142 and 146 are positioned adjacent to the end 156 of the slider 100. The guide legs 144 and 148, however, are not positioned adjacent to the other end 154 of the slider 116. Instead, the guide legs 144 and 148 are spaced from both ends 154 and 156 of the slider 116. In effect, the guide legs 144 and 146 are positioned closer to the center C of the length of the slider 116 than guide legs 144 and 146 are positioned to the end 154 of the slider 116. As such, a substantial length of the guidewalls 130 and 132 extends from the end of the guide legs 144 and 146 to the end 156 of the slider 116.

As also shown in FIG. 8, the sidewalls 130 and 132 of the slider 116 have a curved profile as viewed from the ends 154 and 156 of the slider 116. The curved profile of the sidewalls 130 and 132 makes the shape of the slider 116 more congruent to a finger, particularly, in embodiments that include additional gripping surfaces extending from the sidewalls, as will be described below.

Figure 1A:
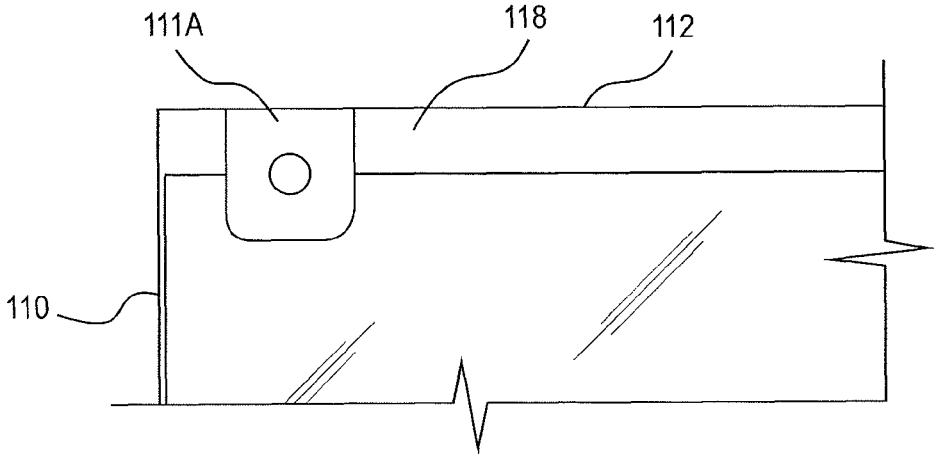
FIG. 1A is a view of an alternative end-stop for a bag according to the invention.

As shown in FIG. 1, end-stops 107 and 111 are formed at the ends of the fastener strips 118 and 120 of the bag 100. The end-stops 107 and 111 function to provide a seal at the ends 106 and 110, and also to prevent the slider 116 from being completely slid off the ends 106 and 110. The end-stops 107 and 111 may be formed by permanently sealing the fastener strips 118 and 120 together at the ends 106 and 110 of the bag 110. A wide variety of techniques may be used to seal the fastener strips 118 and 120 and form the end-stops 107 and 111, such as crushing, ultrasonic vibration, application of heat, etc. FIG. 1A shows an alternative embodiment of the end-stop. In this case, the end-stop includes a separate piece 111A that is applied to the bag 100, with the separate piece functioning to block the movement of the slider towards the end of the bag. Further alternative means for preventing the slider from sliding off the end of the bag include riveted end clamps such as those described in U.S. Pat. Nos. 5,067,208 and 5,161,286, transverse end stops made from molten material of the fastener strips, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807. The disclosures of all of these U.S. patents are incorporated by reference herein.

Figure 10:
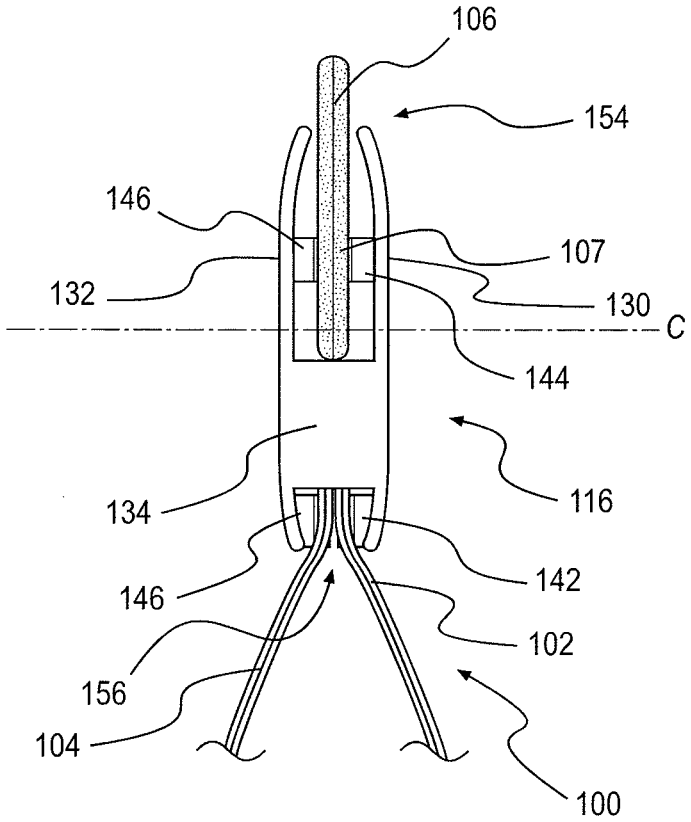
FIG. 10 is a view of a top slider and an end-stop of a bag according to the invention.
Figure 11:
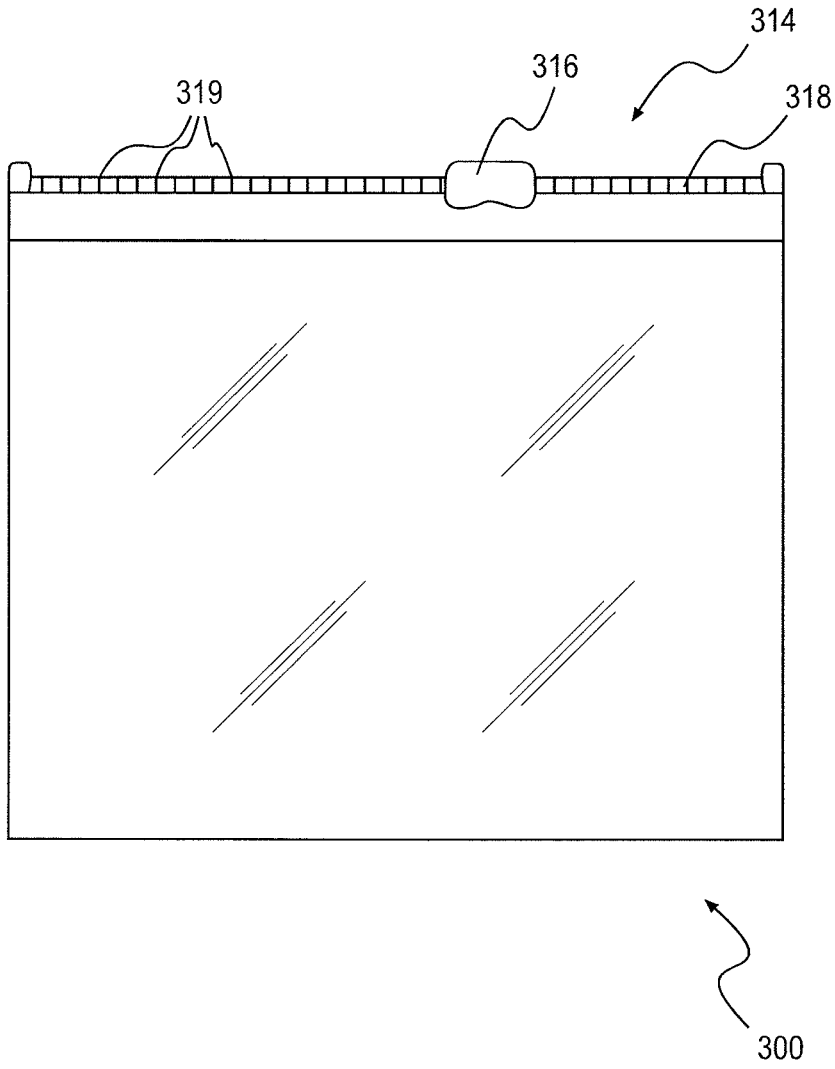
FIG. 11 is a side view a bag according to an alternative embodiment of the invention.

FIG. 10 shows the relative positioning of the slider 100 and the end-stop 107 when the slider 116 is positioned to the end 106 of the bag 100. Because the top wall 134 of the slider 116 is offset from the center C of the length of slider 116, the slider 116 can be moved to a position wherein the end-stop 107 is substantially, if not entirely, positioned between the sidewalls 130 and 132 of the slider 116. That is, the end-stop 107 is received to the center C of the length of the slider 116. Thus, even if the slider 116 has an extended length, the slider 116 can still be moved to a position near the end 106 of the bag 100. This is advantageous because a maximum size of the opening 101 of the bag 101 is thereby maintained, despite the longer length of the slider 116. At the same time, the increased length of the slider 116 makes it easier to grip and to move along the fastener strips 118 and 120. Notably, because the slider 116 closes the fastener strips 118 and 120 when moving in a direction from end 106 to end 110, the offset of top wall 134 towards the end 156 of the slider does not affect the size of the opening 101 that can be formed using the fastener assembly 114 and slider 116.

Figure 12:
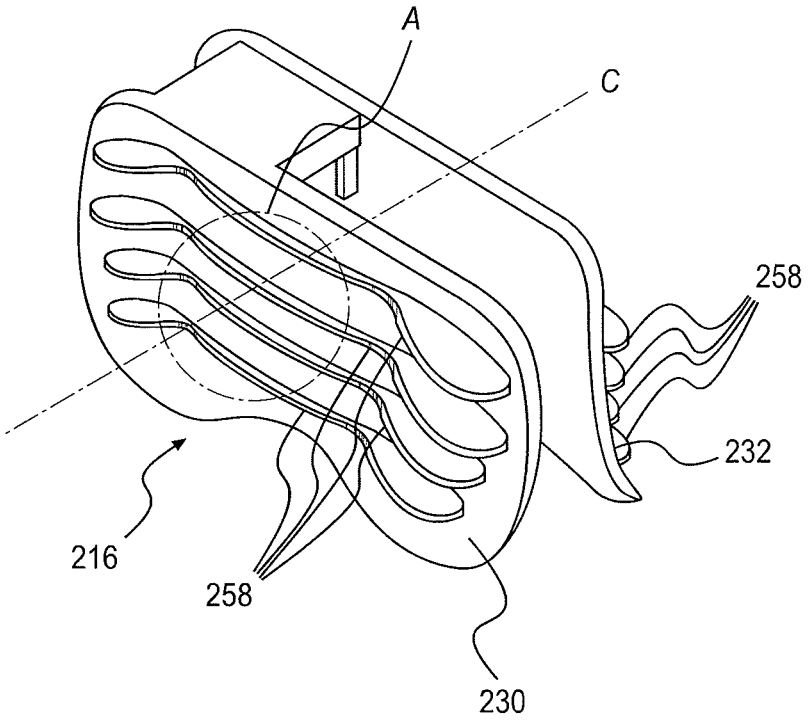
FIG. 12 is an elevation view of a slider according to an alternative embodiment of the invention.

In addition to being easier to grip, the larger size of the slider 116 according to the invention may be advantageous in other ways. This can be seen, for example, in FIG. 12, which depicts a bag 300 according to an alternative embodiment of the invention. The fastener strip 318 of the fastener assembly 314 includes a plurality of indentations 319 along the lengths of the fastener assembly 314. Although not shown in the figure, the fastener strip on the other side of bag 300 opposite from fastener 318 may also include indentations, or include the indentations as an alternative to the indentations 319 provided on fastener strip 314. With such a configuration, an audible and tactile sensation is effected as the slider 316 moves over the indentations 319 in the fastener strip 314. Because the slider 316 according to the invention is made larger than a usual slider, a greater audible and or tactile sensation may be effected. Additional details of indentations being provided in a fastener assembly can be found in U.S. Patent Application Pub. No. 2005/0281492, the disclosure of which is incorporated herein in its entirety.

An alternative embodiment of a slider 216 according to the invention is shown in FIG. 13. In this embodiment, the slider 216 includes a plurality of ridges 258 extending substantially perpendicular from the first sidewall 230, with the ridges 258 running substantially parallel to the length of the slider 216. Similarly, the slider 216 is also be provided with a plurality of ridges 258 extending substantially perpendicular from the second sidewall 232. The ridges 258 are configured such that the ridges extend further from the sidewalls 230 and 232 at the ends of the slider 216 than at an area A near the center of the length of the slider 216. As such, the ridges 258 define a rounded shape that is similar to the shape of a finger. In fact, because of the larger size of the slider 216, the shape and size of the area defined by the ridges 258 closely conforms to the usual size and shape of a finger. As such, the slider 216 is very easy to grip.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

Industrial Applicability

The invention described herein can be used in the commercial production of storage bags. Such storage bags have a wide variety of uses, including use for storing food, chemicals, or other substances.

I claim:

1. A storage bag comprising:

a first side surface;

a second side surface connected to the first side surface so as to define an interior of the bag with an opening thereto;

a first fastener strip positioned adjacent to the opening of the bag, the first fastener strip including at least one interlocking profile;

a second fastener strip positioned adjacent to the opening of the bag, the second fastener strip including at least one interlocking profile configured to interlock with the interlocking profile of the first fastener strip; and a slider including a first sidewall, a second sidewall, and a top wall connecting the first sidewall and the second sidewall, the slider being configured (a) to press together the interlocking profiles of the first and second fastener strips as the slider moves from a first end to a second end of the bag, and (b) to separate the interlocking profiles of the first and second fastener strips as the slider moves from the second end to the first end of the bag, wherein the slider includes (i) a plurality of ridges extending from the first sidewall, the plurality of ridges extending further from the first sidewall at the ends of the slider than at a position at the center of the length of the slider, and (ii) a plurality of ridges extending from the second sidewall, the plurality of ridges extending further from the second sidewall at the ends of the slider than at a position at the center of the length of the slider, wherein a first end-stop is formed by the first and second fastener strips adjacent to the first end of the bag, and a second end-stop is formed by the first and second fastener strips adjacent to the second end of the bag, and wherein the first end-stop can be received between the first and second sidewalls of the slider to a point that is substantially at the center of the length of the slider.

2. The storage bag according to claim 1, wherein the first fastener strip includes first and second interlocking profiles, and wherein the second fastener strip includes first and second interlocking profiles configured to interlock with the first and second interlocking profiles of the first fastener strip.

3. The storage bag according to claim 1, wherein the first and second side surfaces have a multiple layer laminate structure.

4. The storage bag according to claim 3, wherein the multiple layer laminate structure of the first and second side surfaces includes a nylon layer laminated to a polyethylene layer.

5. The storage bag according to claim 1, wherein each of the first and second sidewalls of the slider has a curved profile as viewed from the ends of the slider.

6. The storage bag according to claim 1, wherein at least one of the first and second fastener strips includes a plurality of indentations that effect at least one of an audible and a tactile sensation as the slider moves along the fastener strips.

7. The storage bag according to claim 1, wherein the first and second side surfaces are directly connected at the first and second ends of the bag, and the first and second side surfaces are connected by additional gusset surfaces at a bottom end of the bag.

* * * * *